US008948409B2

(12) United States Patent
Hua

(10) Patent No.: US 8,948,409 B2
(45) Date of Patent: Feb. 3, 2015

(54) AUDIO HEADSET WITH ACTIVE NOISE CONTROL OF THE NON-ADAPTIVE TYPE FOR LISTENING TO AN AUDIO MUSIC SOURCE AND/OR FOR "HANDS-FREE" TELEPHONY FUNCTIONS

(71) Applicant: Parrot, Paris (FR)

(72) Inventor: Phong Hua, Paris (FR)

(73) Assignee: Parrot, Paris (FR)

( * ) Notice: Subject to any disclaimer, the term of this patent is extended or adjusted under 35 U.S.C. 154(b) by 291 days.

(21) Appl. No.: 13/655,819

(22) Filed: Oct. 19, 2012

(65) Prior Publication Data

US 2013/0129105 A1 May 23, 2013

(30) Foreign Application Priority Data

Nov. 22, 2011 (FR) ..... 11 60642

(51) Int. Cl.
*G10K 11/16* (2006.01)
*H04R 1/10* (2006.01)
*H04R 5/033* (2006.01)

(52) U.S. Cl.
CPC ..... *H04R 1/1083* (2013.01); *H04R 1/1008* (2013.01); *H04R 5/033* (2013.01); *H04R 2201/107* (2013.01); *H04R 2420/07* (2013.01); *H04R 2460/01* (2013.01); *H04R 2460/05* (2013.01)
USPC ..... 381/71.6; 381/71.13; 381/71.8; 381/71.2; 381/71.1; 381/94.1

(58) Field of Classification Search
CPC ..... G10K 11/175; G10K 11/1788; G10K 11/1784; G10K 2210/3013; G10K 2210/12; G10K 2210/3011; G10K 2210/1081; G10K 2210/108; G10K 2210/503; G10K 2210/00; G10K 2210/3014; G10K 2210/3023; G10K 2210/30232; H04R 1/1083; H04R 5/033
USPC ..... 381/71.1, 71.6, 71.8, 71.13, 94.1, 94.7, 381/94.9
See application file for complete search history.

(56) References Cited

U.S. PATENT DOCUMENTS 6,449,369 B1 9/2002 Carme et al.
2010/0272276 A1 10/2010 Carreras et al.

*Primary Examiner* — Paul S Kim
*Assistant Examiner* — Sabrina Diaz
(74) *Attorney, Agent, or Firm* — Haverstock & Owens LLP

(57) ABSTRACT

The headset comprises two earpieces each having a transducer for playing back the sound of an audio signal and received in an acoustic cavity defined by a shell having an ear-surrounding cushion. The active noise control comprises, in parallel, a feedforward bandpass filter receiving the signal from an external microphone, a feedback bandpass filter receiving as input an error signal delivered by an internal microphone, and a stabilizer bandpass filter locally increasing the phase of the transfer function of the feedback filter in an instability zone, in particular a waterbed effect zone around 1 kHz. A summing circuit delivers a weighting linear combination of the signal delivered by these filters together with the audio signal to be played back. Control is non-adaptive, with the parameters of the filters being static.

8 Claims, 9 Drawing Sheets

AUDIO HEADSET WITH ACTIVE NOISE CONTROL OF THE NON-ADAPTIVE TYPE FOR LISTENING TO AN AUDIO MUSIC SOURCE AND/OR FOR "HANDS-FREE" TELEPHONY FUNCTIONS

FIELD OF THE INVENTION

The invention relates to an audio headset having an active noise control system.

BACKGROUND OF THE INVENTION

Such a headset may be used for listening to an audio source (e.g. music) coming from an appliance such as an MP3 player, a radio, a smart phone, etc., to which it is connected via a wired connection or indeed via a wireless connection, in particular of the Bluetooth type (registered trademark of Bluetooth SIG).

If it is provided with a microphone set suitable for picking up the voice of the wearer of the headset, the headset may also be used for communications functions, such as "hands-free" telephony functions, in addition to listening to the audio source. The transducer of the headset then reproduces the voice of the remote speaker with whom the wearer of the headset is in conversation.

The headset has two earpieces connected together by a headband. Each earpiece comprises a closed shell housing a sound playback transducer (referred to more simply herein as a "transducer") and being designed to be pressed around the user's ear with an ear-surrounding cushion being interposed to isolate the ear from the external sound environment.

When the headset is used in a noisy environment (metro, busy street, train, airplane, etc.) the wearer is protected from the noise in part by the earpieces of the headset, since they provide insulation by virtue of the closed shell and the ear-surrounding cushion.

Nevertheless, that purely-passive protection is partial only, and a fraction of the external sound, in particular in the low portion of the frequency spectrum can reach the ears by passing through the shells of the earpieces, or indeed through the wearer's skull.

That is why so-called active noise control (ANC) techniques have been developed that are based on the principle of picking up the incident noise component by means of a microphone placed on the shells of the earpieces of the headset, and on superposing an acoustic wave in time and in three dimensions on said noise component, which acoustic wave is ideally an inverted copy of the pressure wave of the noise component. The idea is to create destructive interference with the noise component, thereby reducing and ideally canceling the pressure variations of the interfering acoustic wave.

Implementing this principle involves overcoming a large number of difficulties that have lead to a wide variety of proposals, which proposals can be grouped into two categories.

A first category is that of ANC methods using adaptive filters, i.e. filters having a transfer function that is modified dynamically and continuously by an algorithm that acts in real time to analyze the signal. Such processing is made possible in particular as a result of developments in techniques for digitizing and processing signals by means of specialized processors, that are programmed to implement algorithms in real time.

DE 37 33 132 A1 is a typical example of ANC processing making use of such adaptive filters. Other examples of ANC methods involving adaptive filters are described in particular in U.S. Pat. No. 6,041,126 A, US 2003/0228019 A1, and WO 2005/112849 A2.

Those techniques can be effective in terms of reducing noise, but they present the drawback of necessarily being digital and of requiring relatively large amounts of computation power, with the consequences of being relatively complex to design and quite expensive to make.

Furthermore, the digital processing gives rise to non-negligible delays in the compensation signal, and the adaptive feature involves some minimum length of convergence time for the algorithms. All of that is harmful to the reactivity of the system, in particular in response to noises that are irregular. As a result, the denoising is effective in particular against noise that is essentially periodic and in narrow band.

The second category of ANC methods—to which the technique of the invention belongs—is that of filter systems that are static, i.e. non-adaptive, in which the parameters of the various filters used are predetermined.

Such ANC systems combine static filtering of the feedback type in a closed loop and of the feedforward type in an open loop. The feedback channel is based on a signal picked up by a microphone placed inside the acoustic cavity (referred to below as the "front" cavity) defined by the shell of the earpiece, the ear-surrounding cushion, and the transducer. In other words, this microphone is placed close to the user's ear and receives mainly the signal produced by the transducer and the residual, non-canceled noise signal that is still perceptible in the front cavity. The audio signal from the music source that is to be played back by the transducer is subtracted from the signal from this microphone so as to constitute an error signal for the feedback loop of the ANC system. The feedforward filter channel makes use of the signal picked up by the external microphone picking up the interfering noise that exists in the immediate environment of the wearer of the headset.

One such system is described in particular in US 2010/0272276 A1 that, in addition to the feedback and feedforward filter channels, also provides a third filter channel that processes the audio signal from the music source that is to be played back. The output signals from the three filter channels are combined and applied to the transducer in order to play back the signal from the music source in association with a signal for suppressing the surrounding noise.

Since the parameters of the various filters are static, static filtering techniques can be implemented equally well in analog technology or in digital technology, in manners that require fewer resources than are required for adaptive filter techniques.

Nevertheless, static filtering methods present limitations and drawbacks.

A first drawback is relatively great sensitivity to variations in the electroacoustic paths between the transducer and the error microphone, i.e. the internal microphone placed in the front cavity. The electroacoustic response between those two elements can be modified as a result of the variations in the volume of the front cavity and in its sealing relative to the outside. The main factors that might cause this electroacoustic response to vary are the positioning of the headset on the head, the shape of the user's ear, the tightness with which the headset is pressed against the head, and the presence of hair where the ear-surrounding cushions press against the head. Other variations may be due to the electronic components used (resistors, capacitors, transducer, and microphone) since they present electrical characteristics that might fluctuate over time.

These variations in the acoustic response can produce an undesirable effect known as the "waterbed" effect: beyond the main noise suppression frequency band, noise becomes amplified in a relatively narrow frequency band, generally around 1 kilohertz (kHz) in a manner that is entirely perceptible and naturally unwanted. If this phenomenon is too great it can even give rise to a Larsen effect, a phenomenon that is to be observed with many headsets when the cushion is accidentally removed.

Another factor to be taken into account is the volume of the front cavity, insofar as a small front volume increases the variability of the electroacoustic response between the transducer and the error microphone, since under such circumstances, there is a greater relative variation in volume between the normal listening position and the transition position in which the user moves the headset closer to the head.

A small volume for the front cavity is thus an additional factor for loss of stability in the feedback loop, with the same consequences as those explained above. In practice, it is desirable for earpieces to be made with relatively small volume, both for reasons of comfort and for reasons of weight, and that goes against the requirement for stability in the ANC system.

Specifically, the various filtering channels are adjusted so as to produce performance that corresponds to a given electroacoustic response, with gain and phase margins that make it possible to guarantee stability that is sufficient and performance that is maximized. In this respect, it is considered that a closed-loop system must generally present a phase margin of more than 45° and a gain margin of at least 10 decibels (dB). However those theoretical margins are often found to be insufficient because of the great variability in the electroacoustic responses that are to be found in practice in the field of headsets with active noise control.

OBJECT AND SUMMARY OF THE INVENTION

In such a non-adaptive ANC system, the problem of the invention is to combat risks of instability, with increased gain and phase margins that make it possible, in spite of the small volume of the front cavity, to avoid any appearance of the waterbed effect or the Larsen effect in spite of variations in the positioning of the headset on the head, the tightness of the earpieces, and the better or poorer sealing provided by the ear-surrounding cushions.

This increase in stability must naturally be obtained without degrading the anti-noise performance of the ANC system, i.e. it must continue to be equally effective in canceling interfering noise components, regardless of their more or less periodic characteristic and regardless of their frequency spectrum.

Naturally, the audio signal from the music source (or the voice of the remote speaker in a telephony application) must not be distorted, and its spectrum must not be cut down by the ANC processing, even though the noise canceling signal and the audio signal to be played back are amplified by the same channels and reproduced by the same transducer.

The idea on which the invention is based consists in reducing the passband of the feedback filter in the high portion of the spectrum, i.e. in the unstable frequency zone, so as to reduce or eliminate any risk of the waterbed effect or the Larsen effect. As explained below, limiting the passband in this way can give rise to an increase in the gain margin of at least 15 dB, and preferably of at least 17 dB, and an increase in the phase margin of at least 45°, and preferably of at least 60°.

In parallel, the feedforward filter compensates for the loss of performance in the higher frequencies of the noise spectrum to be eliminated (i.e. around 1 kHz).

Finally, a stabilizer filter is connected in parallel with the feedback filter. The stabilizer filter serves to increase the phase margin of the feedback filter by increasing phase in the critical zone of the waterbed effect: in order to compensate for the reduction in phase due to the acoustics, in particular as a result of the path along which sound propagates from the transducer to the error microphone, limited resonance is created by the stabilizer filter so as to increase the phase and thus increase the phase margin.

These three channels (feedback, feedforward, and stabilizer) are connected in parallel, and the signals delivered as outputs from the filters are combined with one another and with the audio signal for playing back by means of a combiner that delivers a linear combination of these various signals, for amplification and playback by the transducer. More precisely, the invention provides a headset having an active noise control system that comprises, in a manner that is itself known from above-mentioned US 2010/0272276 A1, two earpieces connected together by a headband and each including a transducer for playing back the sound of an audio signal that is to be reproduced, the transducer being housed in an acoustic cavity defined by a shell provided with an ear-surrounding cushion. The headset including an active noise control system comprising:

- an open-loop feedforward first branch with a first bandpass filter receiving as input a signal delivered by an external microphone suitable for picking up acoustic noise existing in the environment of the headset;
- a closed-loop feedback second branch with a second bandpass filter receiving as input an error signal delivered by an internal microphone inside the cavity;
- a third branch with a third filter; and
- a mixer circuit receiving as inputs the signals delivered by the first, second, and third filters and also the audio signal to be played back, and delivering as output a signal suitable, after amplification, for controlling the transducer.

In manner characteristic of the invention:

- the active noise control is non-adaptive control, the parameters of the first, second, and third filters being predetermined parameters;
- the third filter is a stabilizer bandpass filter connected in parallel with the feedback second branch, receiving as input the signal delivered by the internal microphone, and delivering as output a signal that is applied as an input to the combining circuit, the third filter being suitable for locally increasing the phase of the transfer function of the second filter in a predetermined instability zone; and
- the first, second, and third branches are arranged in parallel, and the mixing circuit is a summing circuit delivering as output a linear combination of the signals delivered by the first, second, and third filters together with at least a fraction of the audio signal to be played back, with respective weighting of the gains applied to these signals.

The predetermined instability zone in question is in particular a waterbed effect zone around a frequency of 1 kHz.

The high cutoff frequency of the second filter is preferably less than 150 Hz, preferably less than 120 Hz, and its bandwidth less than 65 Hz, preferably less than 55 Hz.

The gain margin of the feedback branch of the active noise control is advantageously at least 15 dB, preferably at least 17 dB, and the phase margin at least 45°, preferably at least 60°.

The audio signal to be played back is preferably applied as input both to the second filter and to the summing circuit, the second filter receiving as input a signal obtained by combining said error signal delivered by the internal microphone with at least a fraction of the audio signal for play-back, and it is not applied to the third filter.

BRIEF DESCRIPTION OF THE DRAWINGS

There follows a description of an embodiment of the device of the invention given with reference to the accompanying drawings in which the same numerical references are used from one figure to another to designate elements that are identical or functionally similar.

MORE DETAILED DESCRIPTION

Figure 1:
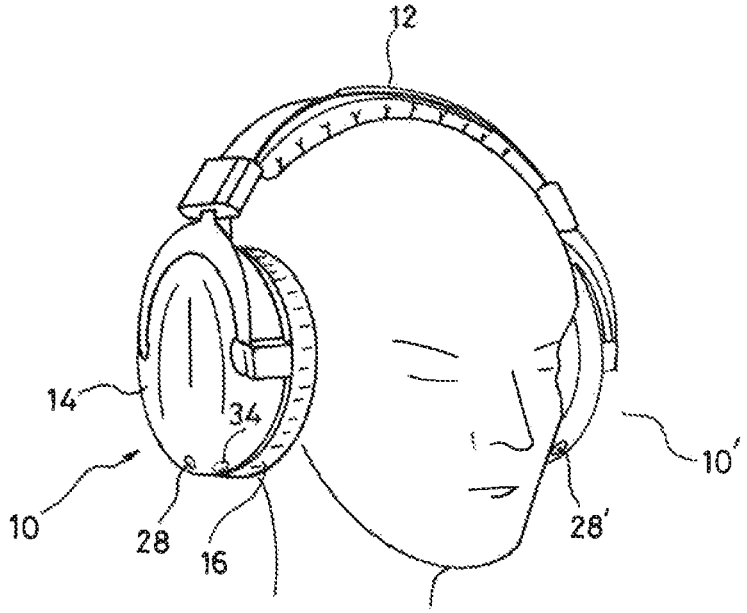
FIG. 1 is a general view of an audio headset in place on a user's head.

FIG. 1 shows an audio headset on the head of a user. In conventional manner, the headset comprises two earpieces 10 and 10' connected together by a headband 12. Each of the earpieces 10 comprises an outer shell 14 that presses around the outline of the user's ear with a flexible ear-surrounding cushion 16 interposed between the shell 14 and the periphery of the ear in order to ensure satisfactory sealing, from an acoustic point of view, between the vicinity of the ear and the external sound environment.

Figure 2:
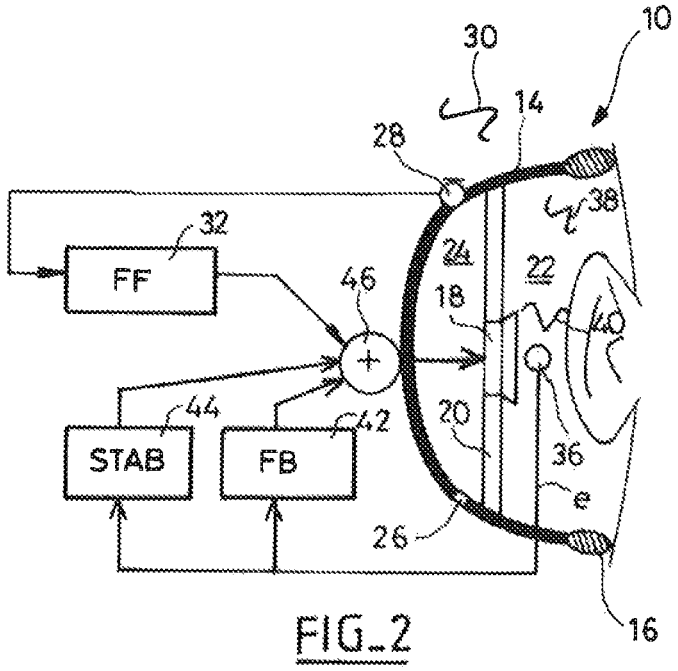
FIG. 2 is a diagrammatic view showing the various acoustic and electrical signals and also the various functional blocks involved in the operation of an audio headset with active noise control.
Figure 3:
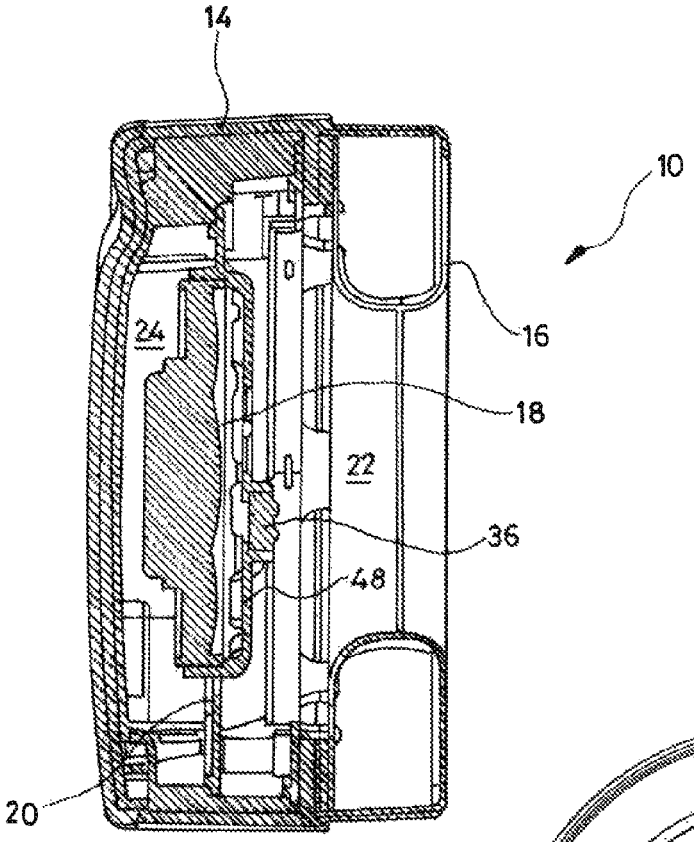
FIG. 3 is an elevation view in section of one of the earpieces of the headset of the invention, showing the configuration of the various mechanical elements and electromechanical members therein.
Figure 4:
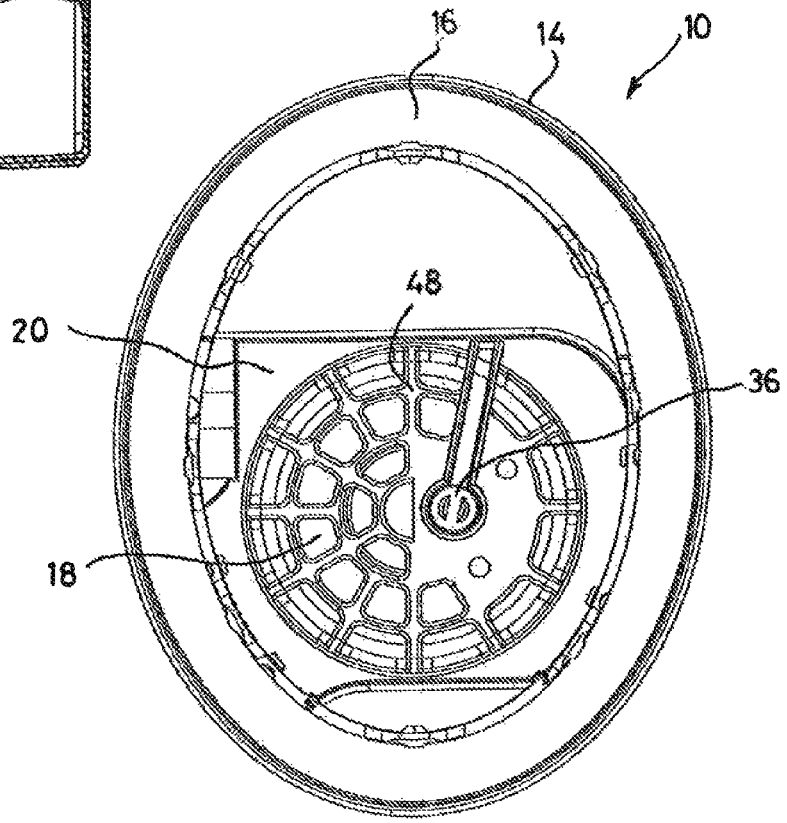
FIG. 4 is a face view of the FIG. 3 earpiece.

FIG. 2 is a diagram showing the various acoustic and electrical signals and the various functional blocks involved in the operation of an audio headset with active noise control.

The earpiece 10 encloses a sound play back transducer 18, referred to below simply as the "transducer", which is carried on a partition 20 defining two cavities, namely a front cavity 22 beside the ear and a rear cavity 24 on the opposite side.

The front cavity 22 is defined by the internal partition 20, the wall 14 of the earpiece, the cushion 16, and the outside face of the user's head in the region of the ear. This cavity is a cavity that is closed, with the exception of inevitable acoustic leaks in the contact region of the cushion 16.

The rear cavity 24 is a cavity that is closed, with the exception of an acoustic vent 26 serving to reinforce low frequencies in the front cavity 22 of the earpiece. Such acoustic reinforcement is more advantageous than electrical amplification, since it enables the ambient noise overpressure effect to be improved by the active control system without saturation and with less electrical noise.

For active noise control, the earpiece 10 carries an external microphone 28 for picking up the surrounding noise outside the earpiece, represented diagrammatically by a wave 30. The signal picked up by the external microphone 28 is applied to a feed-forward filter stage 32 of the active noise control system.

Each earpiece 10 and 10' has its own active noise control system, with the respective external microphones 28 and 28' (FIG. 1) being independent of each other.

As shown in FIG. 1, the headset may possibly carry another external microphone 34 for performing communications functions, for example if the headset is provided with "hands-free" telephony functions.

The additional external microphone 34 is for picking up the voice of the wearer of the headset, it is not involved in the active noise control, and below consideration is given only to the external microphone(s) 28 that are dedicated to active noise control.

The headset is also provided with an internal microphone 36 placed as close as possible to the auditory canal of the ear in order to pick up the residual noise present in the internal cavity 22, which noise will be perceived by the user.

Ignoring the audio signal from the music source played back by the transducer (or the voice of the remote speaker, in a telephony application), the acoustic signal picked up by this internal microphone 36 is a combination:

- of the residual noise 38 coming from surrounding external noise 30 transmitted through the shell 14 of the earpiece; and
- of a soundwave 40 generated by the transducer 18 that, ideally, is an inverted copy of the noise 30, i.e. of the noise for suppressing at the listening point, on the principle of destructive interference.

Since cancellation of the noise by means of the soundwave 40 is never perfect, the internal microphone 36 picks up a residual signal that is used as an error signal e for application to a closed-loop feedback filter branch 42 and to a stabilizer branch 44 (specific to the invention) that deliver signals that are combined at 46 with the signal from the open-loop feedforward branch 32 in order to control the transducer 18.

In addition, the transducer 18 receives an audio signal for play-back coming from a music source (player, radio, etc.), or else the voice of a remote speaker in a telephony application. Since this signal is subjected to the effects of the closed loop that distorts it, it is subjected to upstream pretreatment by equalization in a digital signal processor so as to present the desired transfer function as determined by the open-loop gain and the target response without active control.

FIGS. 3 to 6 are views from a plurality of angles showing an embodiment of the various mechanical and electroacoustic elements that are shown diagrammatically in FIG. 2, for one of the earpieces 10 (the other earpiece 10' being made identically).

Figure 5:
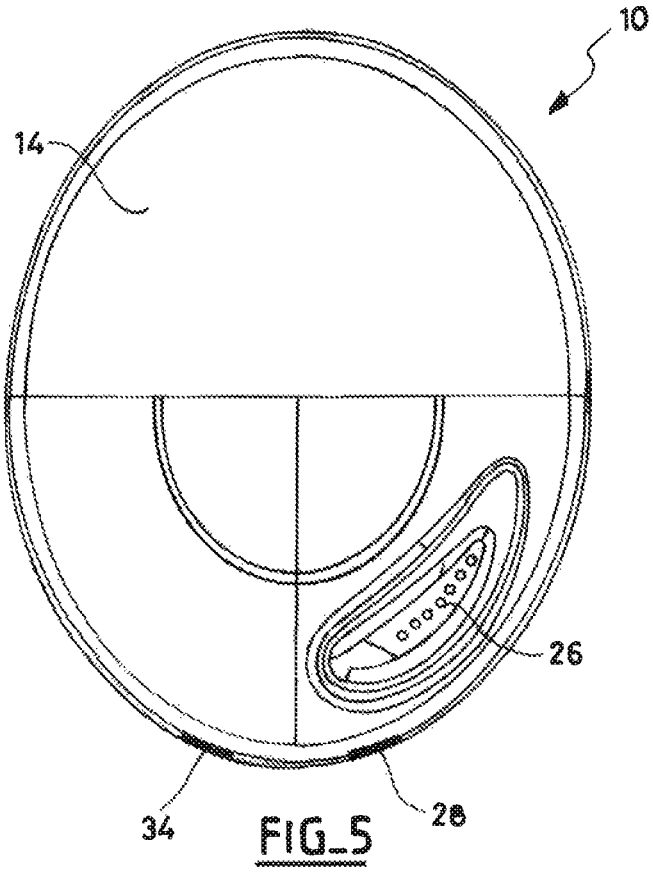
FIG. 5 is a back view of the earpiece of FIGS. 3 and 4.
Figure 6:
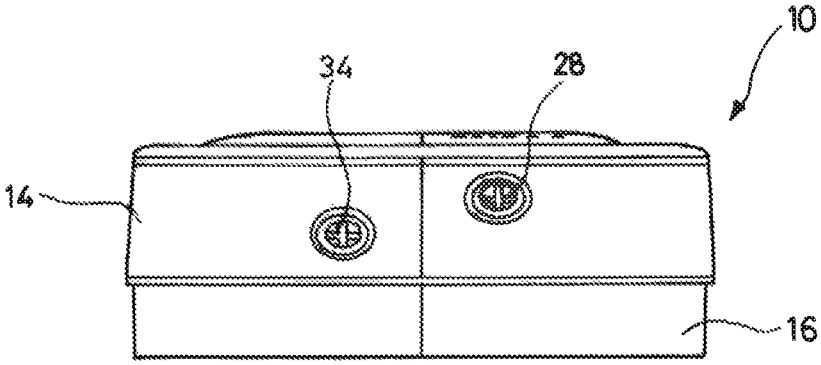
FIG. 6 is a view from beneath of the earpiece of FIGS. 3 to 5.

There can be seen the partition 20 dividing the inside of the shell 14 into a front cavity 22 and a rear cavity 24 with the transducer 18 and the internal microphone 36 mounted on this partition, the internal microphone 36 being carried by a grid 48 for holding it close to the user's auditory canal. FIGS. 5 and 6 also show the external microphone 28 dedicated to active noise control and the additional microphone 34 for "hands-free" communications functions, together with the vent 26 that is constituted for example by a series of small holes covered by a grid of acoustically resistive plastics material.

Figure 7:
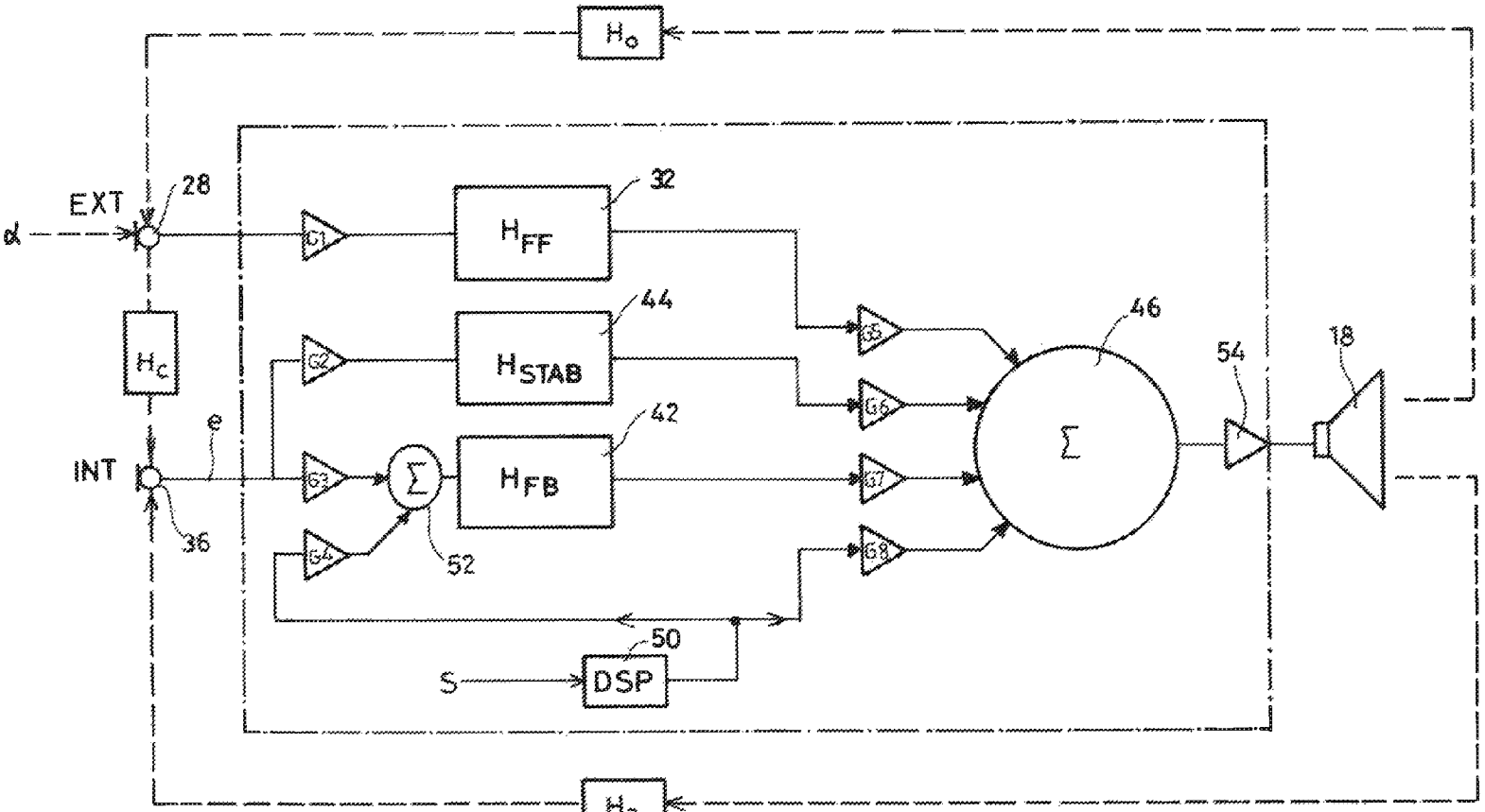
FIG. 7 is a general view in the form of a block diagram showing the various elements of the active noise control system of the headset of the invention.

FIG. 7 is a block diagram showing the active noise control circuit of the invention, together with the electrical and acoustic transfer functions involved in the operation of this circuit.

The circuit essentially comprises three branches connected in parallel, namely a feedforward filter 32, a feedback filter 42, and a stabilizer filter 44.

The signal picked up by the external microphone 28 is preamplified by gain G1 (e.g. G1=+8 dB) and then applied of the feedforward filter 32.

The signal picked up by the internal microphone 36 is applied both to the stabilizer filter 44 and to the feedback filter 42, with respective gains G2 (e.g. G2=0 dB) and G3 (e.g. G3=+9 dB) being applied.

The signals delivered in parallel by the filters 32, 44, and 42 are combined with one another by a summing circuit 46 with respective gains G5, G6, and G7 being applied thereto (e.g. G5=−6 dB for the signal from the feedforward filter 32, G6=+6 dB for the signal from the stabilizer filter 44, and G7=0 dB for the signal from the feedback filter 42).

The audio signal S (a "line-in" signal) from the music source (MP3 player, radio, etc.) or from the telephony circuits is subjected to digital processing (decoding, equalization, audio effects such as spatialization, etc.) by a digital signal processor (DSP) 50. Furthermore, since this signal is subjected to the effects of the closed loop, which effects distort it, it is preprocessed upstream in the DSP 50 by appropriate equalization, so as to present the desired transfer function, as determined by the open-loop gain and the target response without active control.

The audio signal of the output from the DSP 50 is applied to the active control circuit at two locations, respectively:

- with application of gain G4 (e.g. G4=−14 dB), to the feedback filter 42; and
- with application of gain G8 (e.g. G8=−6 dB) to a summing circuit 52 that combines this signal with the signal picked up by the internal microphone 36 after that signal has been preamplified with the gain G3, for application as input to the feedback filter 32.

Injecting the audio signal S for play-back into two different locations of the circuit makes it possible to obtain balanced equalization between low frequencies and high frequencies. The portion of the signal that is injected to the input of the general summing circuit 46 is subjected to the attenuation of the active control, thereby producing high frequency components; in contrast, the portion of the signal injected via the summing circuit 52 to the input of the feedback filter 42 is subjected to the lowpass filtering of the circuit, giving low frequency components. The respective gains G8 and G4 applied to these two portions of the signal serve to balance the low and high frequencies of the spectrum of the signal for play-back.

It should be observed that the audio signal for play-back is injected only into the input of the feedback filter 42 (via the summing circuit 52), but is not injected into the branch having the stabilizer filter 44, thus making it possible to adjust the stabilizer filtering without disturbing the equalization of the music to be played back: the stabilizer filter 44 receives only the sound picked up by the internal microphone 36, to the exclusion of the audio signal for play-back, which therefore does not interfere with the stabilization function.

Finally, the output from the general summing circuit 46, which is a linear combination of the signal from the three filter channels, for feedforward, feedback, and stabilization filtering together with the audio signal for play-back, is applied to the transducer 18 after amplification by a power stage 54.

Figure 8:
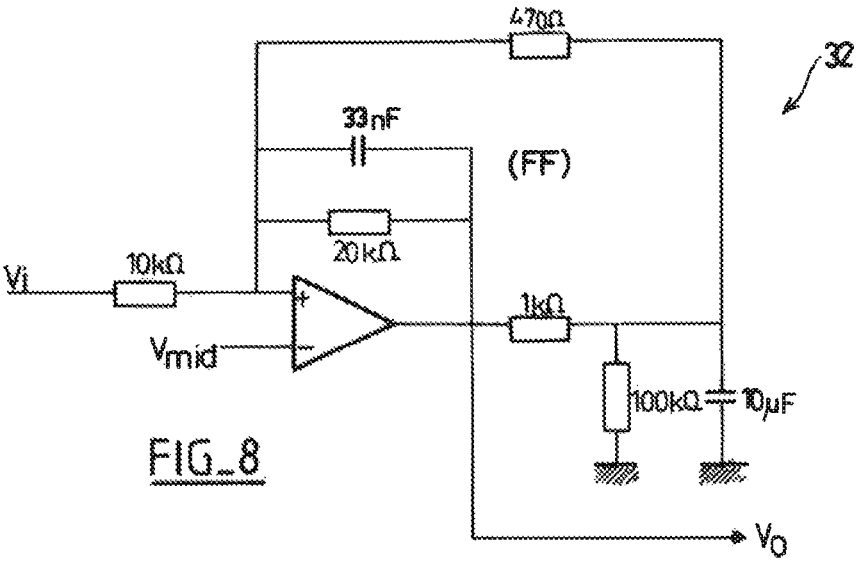
FIG. 8 shows an embodiment in analog form of the feedforward filter of FIG. 7.
Figure 9:
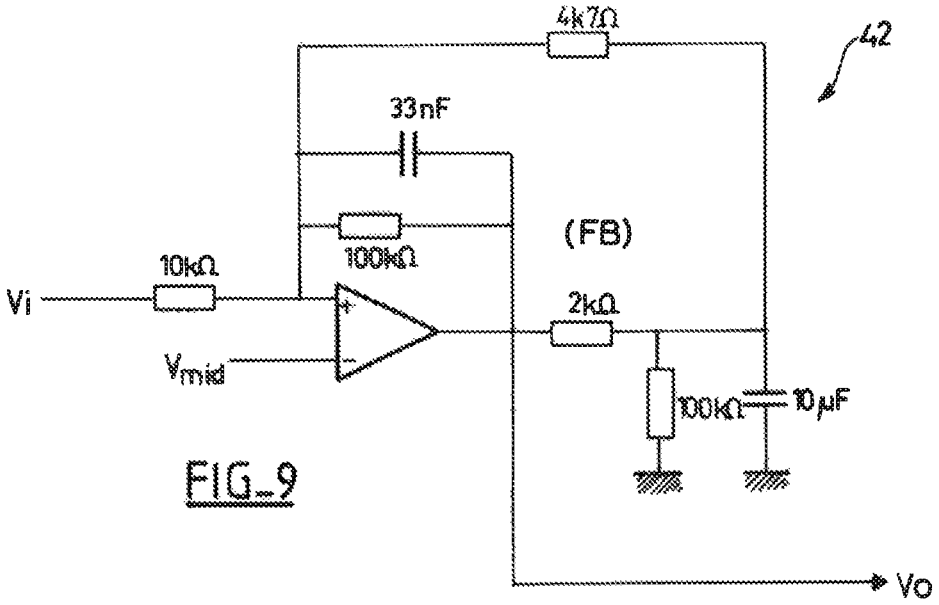
FIG. 9 shows an embodiment in analog form of the feedback filter of FIG. 7.
Figure 10:
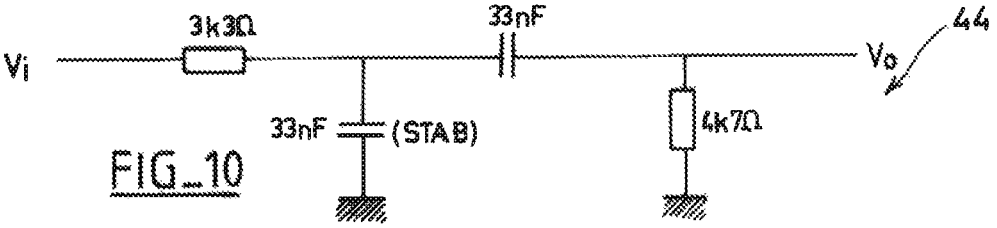
FIG. 10 shows an embodiment in analog form of the stabilizer filter of FIG. 7.

FIGS. 8, 9, and 10 show embodiments in analog technology respectively of the feedforward filter 32, the feedback filter 42, and the stabilizer filter 44. In these figures, $V_i$ and $V_o$ indicate the input and output voltages respectively of the filters, and $V_{mid}$ indicates the middle voltage between the positive and negative terminals of the power supply of the operational amplifier used by the filter. The respective transfer functions of these various filters are described below in greater detail with reference to FIGS. 12 to 17 in particular together with the manner in which the stabilizer filter 44 enables the response of the feedback filter 42 to be modified so as to increase the overall performance of the active noise control system.

As can be seen, these three filters can be implemented with very few components, and thus with very low hardware costs.

Furthermore, in the examples shown, the feedforward and feedback filters 32 and 42 are made in the form of first order lowpass filters, however it is possible without difficulty to make second order bandpass filters by changing the resistors and the capacitors.

There follows a description of the general operation of the active noise control system of the invention, for which the general architecture is described above.

The following notation is used:

- $H_c$: the transfer function between the signal received by the external microphone 28 and the signal received by the internal microphone 36, representative of the fraction of the external noise that passes through the shell of the earpiece of the headset;
- $H_o$: the transfer function between the signal played back by the transducer 18 and the signal received by the external microphone 28, representative of the fraction of the acoustic signal that is transmitted through the shell of the earpiece to the external microphone;
- $H_a$: the transfer function between the signal produced by the transducer 18 and the signal received by the internal microphone 36;
- d: the surrounding noise signal (the noise signal that is to be attenuated, ideally to be canceled, by the active control);
- e: the error signal delivered by the internal microphone 36 (the signal that it is to be minimized);
- $H_{FF}$: the transfer function of the feedforward filter 32 (which is a static function, i.e. it is not adaptive); and
- $H_{FB}$: the transfer function of the feedback filter 42 (which is likewise a static function), possibly modified by operation of the stabilizer filter 44.

If it is desired to represent the error signal e as a function of the noise signal d, then the following transfer function is obtained from the external microphone 28 to the internal microphone 36 (this microphone, which is situated as close as possible to the auditory canal of the user, represents the signal perceived at the listening point):

$$\frac{e}{d} = \frac{H_c + H_{FF}(H_a + H_O) + \varepsilon}{1 - H_{FB}(H_a + H_O)}$$

The term $\epsilon$ represents all of the feedback of orders greater than or equal to 2; specifically, this term is negligible compared with the other terms of the numerator and it is ignored. Furthermore, $|H_o| << |H_a|$, since $H_o$ contains additional attenuation due to the shell of the earpiece.

Figure 11:
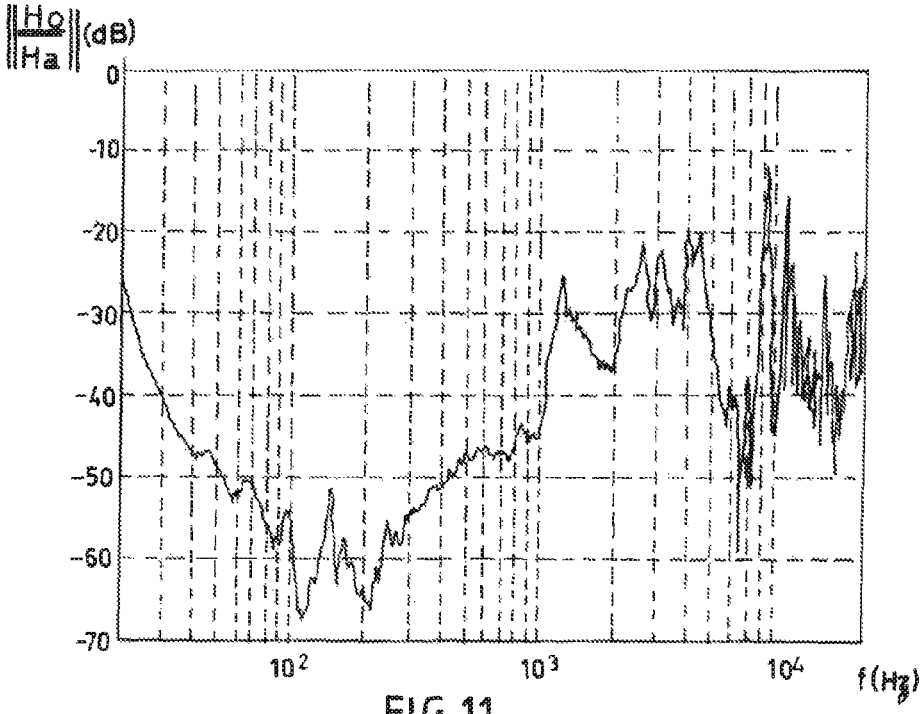
FIG. 11 is a characteristic showing the attenuation introduced by the shell of the earpiece, relative to the internal attenuation of the front cavity of the earpiece.

FIG. 11 is an experimental plot of the modulus of $H_o/H_a$ as a function of frequency, thus representing the attenuation of the shell of the earpiece relative to the internal attenuation of the cavity.

By making the approximation $|H_o| << |H_a|$, the transfer function of the noise can thus be simplified as follows:

$$\frac{e}{d} = \frac{H_c + H_{FF}H_a}{1 - H_{FB}H_a}$$

For the noise picked up by the internal microphone to be low, i.e. in order to minimize the error signal, it is necessary for:

$$\frac{e}{H_c d} = \frac{1 + \frac{H_a H_{FF}}{H_c}}{1 - H_a H_{FB}}$$

From a stability point of view, the stability of the feedforward $H_{FF}$ is better than that of the feedback $H_{FB}$ because there is no feedback loop (the feedforward filter is an open loop filter).

In contrast, as explained in the introduction, feedforward and feedback tend to produce an undesired effect of amplifying noise in a narrow frequency band beyond the noise suppression band, and generally around 1 kHz ("waterbed effect"). In addition, with the feedback of the feedback filter, this effect can quickly race away and become transformed into the Larsen effect.

Unfortunately, although feedforward is more stable, it cannot be used without feedback since the noise suppression it provides on its own is less effective. In order to have perfect suppression, it is necessary for $H_{FF}=H_c/H_a$ which is difficult to achieve since $H_c$ and $H_a$ are highly variable for the reasons mentioned above: front volume variable and small, position and tightness of the headset, etc. In practice, noise suppression by a feedforward filter alone is typically close to 10 dB, whereas with a feedback filter it is possible to achieve 20 dB.

The invention serves specifically to mitigate the drawbacks described above. Essentially, the invention proposes:

1) reducing the frequency band of the feedback filter so as to increase the gain and phase margins (typically to at least 15 dB and 60°), in particular in the frequency range where there is a risk of uncontrolled instability;

2) using the feedforward filter to compensate the corresponding loss of performance at higher frequencies (up to 1 kHz); and 3) reducing the waterbed effect by a stabilizer filter associated with the feedback filter, thus making it possible to reduce or even eliminate any risk of the Larsen effect.

It should be observed that increasing the gain and phase margins by reducing the passband has been selected in preference to reducing open-loop gain (which would also have served to increase those margins): such a reduction in open-loop gain suffers from the drawback of reducing the maximum performance of the active noise control, as contrasted with reducing passband, since that only reduces the attenuation frequency band of the noise control circuit. It is thus in order to avoid reducing the maximum noise attenuation that passband reduction is selected in preference to reducing the open-loop gain of the feedback filter.

The feedforward filter is more stable since it operates in an open loop. It can therefore be used in the higher frequencies (up to 1 kHz) for compensating the loss of passband in the feedback filter. The feedforward filter presents low gain and has a Q-factor (quality factor) that is small compared with that of the feedback filter, and its performance is adjusted to cover a broad frequency band.

Figure 12:
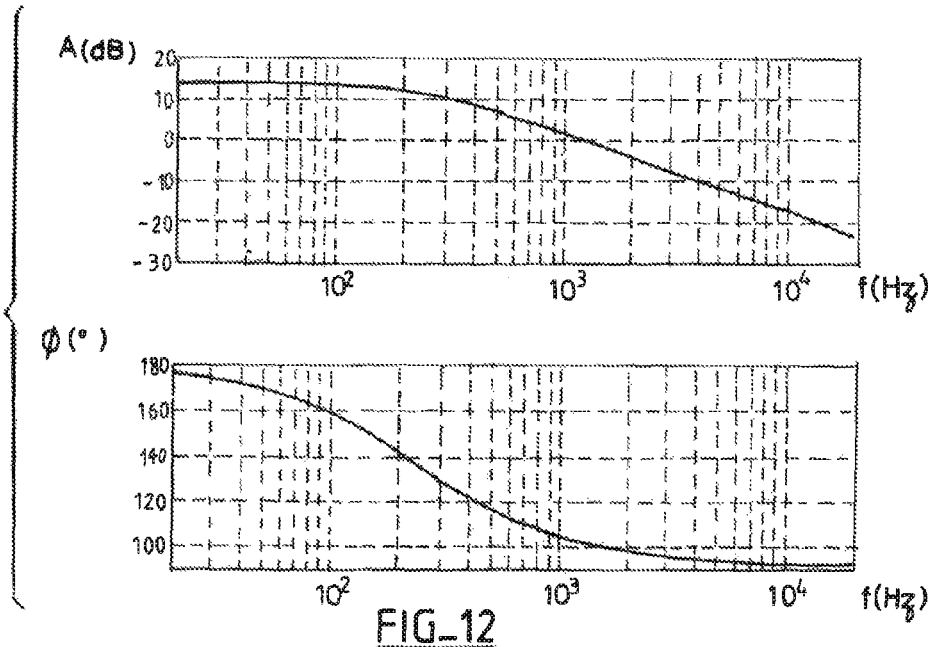
FIG. 12 is a Bode diagram showing the amplitude and the phase of the transfer function of the feedforward filter of the FIG. 7 circuit.

FIG. 12 is a Bode diagram of the feedforward filter 32, showing its amplitude and phase as a function of frequency.

By being connected in parallel with the feedback filter 42, the stabilizer filter 44 serves to increase the phase margin of the feedback filter, in particular in the critical waterbed effect zone. In order to compensate for the reduction in phase due to acoustics, in particular because the acoustic path over which the sound propagates from the transducer to the error microphone (transfer function $H_a$), the stabilizer filter creates local resonance in this zone serving to increase the phase and thus increase the phase margin.

These various aspects can be seen in particular in the example diagrams of FIGS. 13 to 17.

Figure 13:
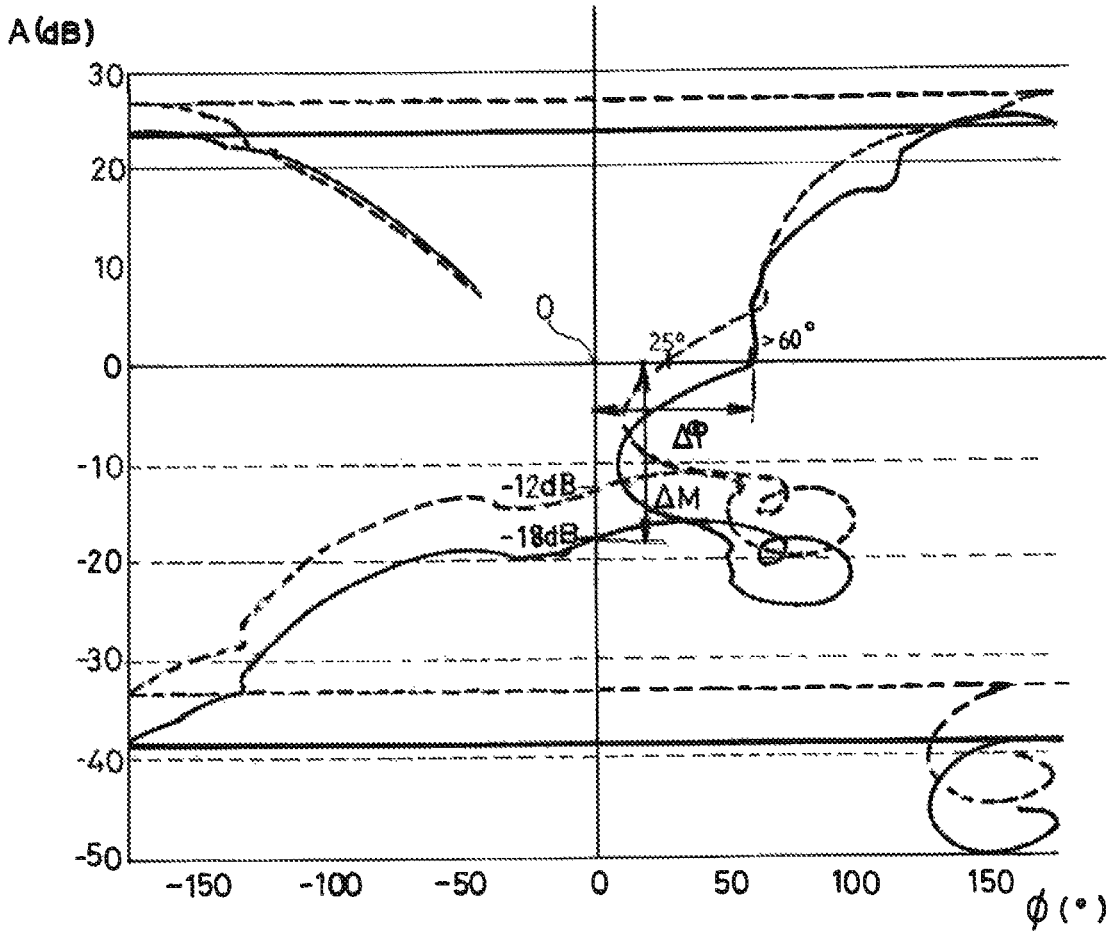
FIG. 13 shows the Black locus of the active noise control system of the invention, with and without the action of the stabilizer filter.

FIG. 13 shows the Black locus of the system, i.e. a Cartesian plot of the modulus of the open loop ($H_aH_{FB}$) as a function of its phase, with frequency being varied from 0 Hz to infinity. By tracing this Black locus, it is easy to read the gain and phase margins, which are given by the points where the locus intersects the two axes passing through the instability point O, situated at 0 dB and 0°.

In FIG. 13, the dashed line is the Black locus with feedback filtering alone prior to passband reduction, and the continuous line applies to the same filter but with its passband reduced (but without the stabilizer). Initially the gain and phase margins $\Delta M$ and $\Delta\phi$ are respectively −12 dB and 25°, and it can be seen that reducing the passband enables these values to be increased respectively to −18 dB and more than 60°.

Figure 14:
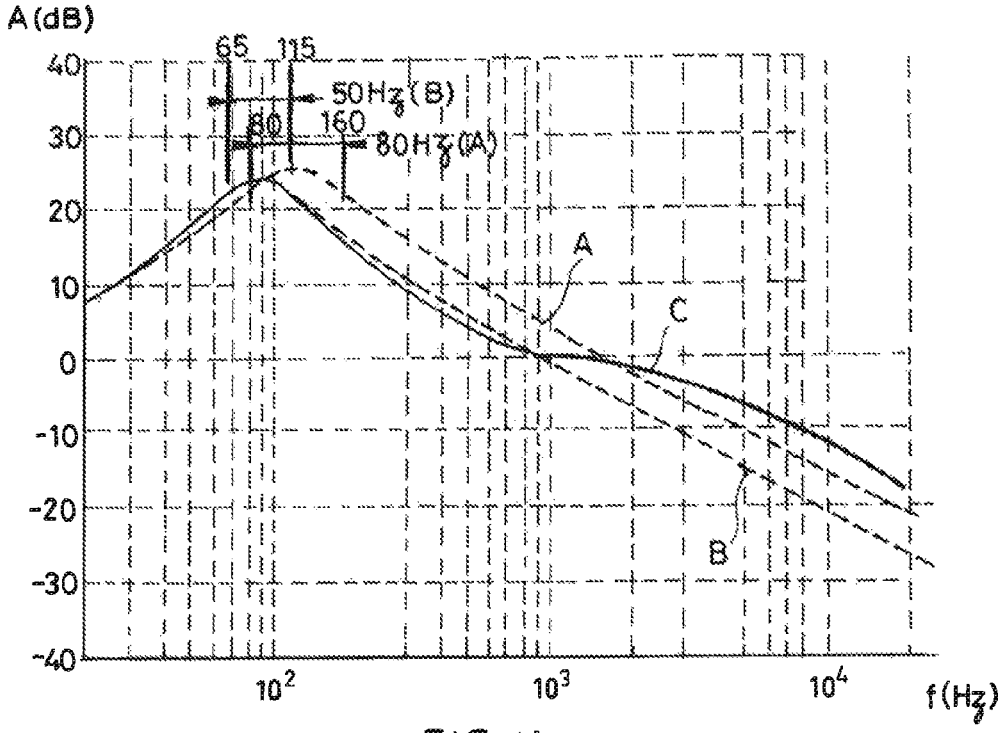
FIG. 14 shows the modulus of the transfer function of the feedback filter of the FIG. 7 circuit for various configurations (with full passband, with reduced passband, with and without stabilizer filter).
Figure 15:
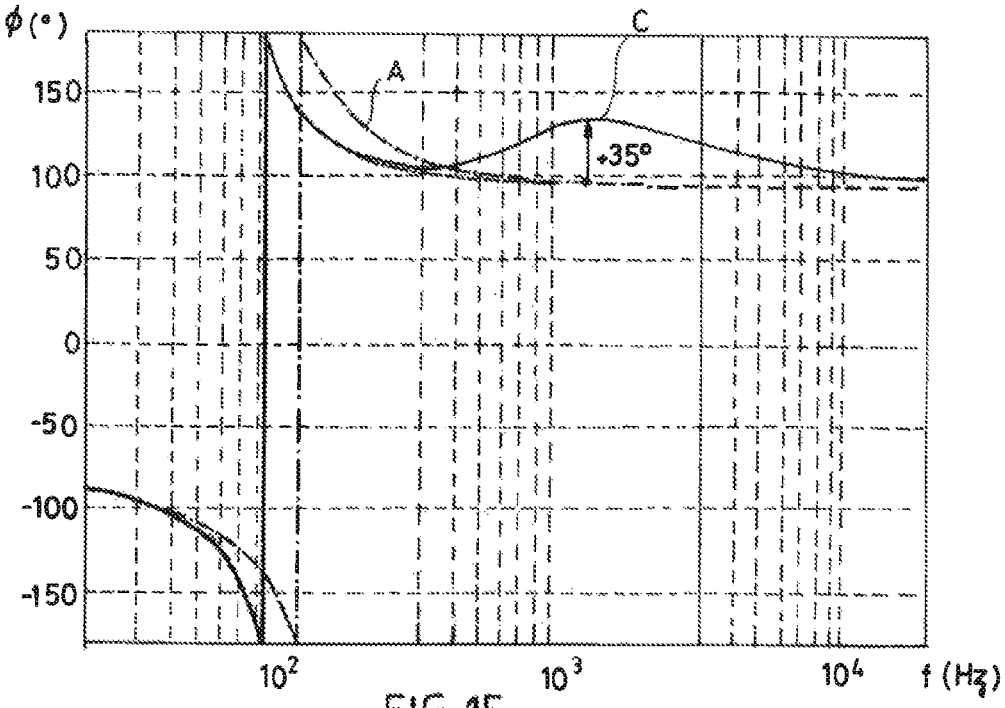
FIG. 15 shows the phase of the transfer function of the feedback filter of the FIG. 7 circuit, likewise for various configurations.
Figure 16:
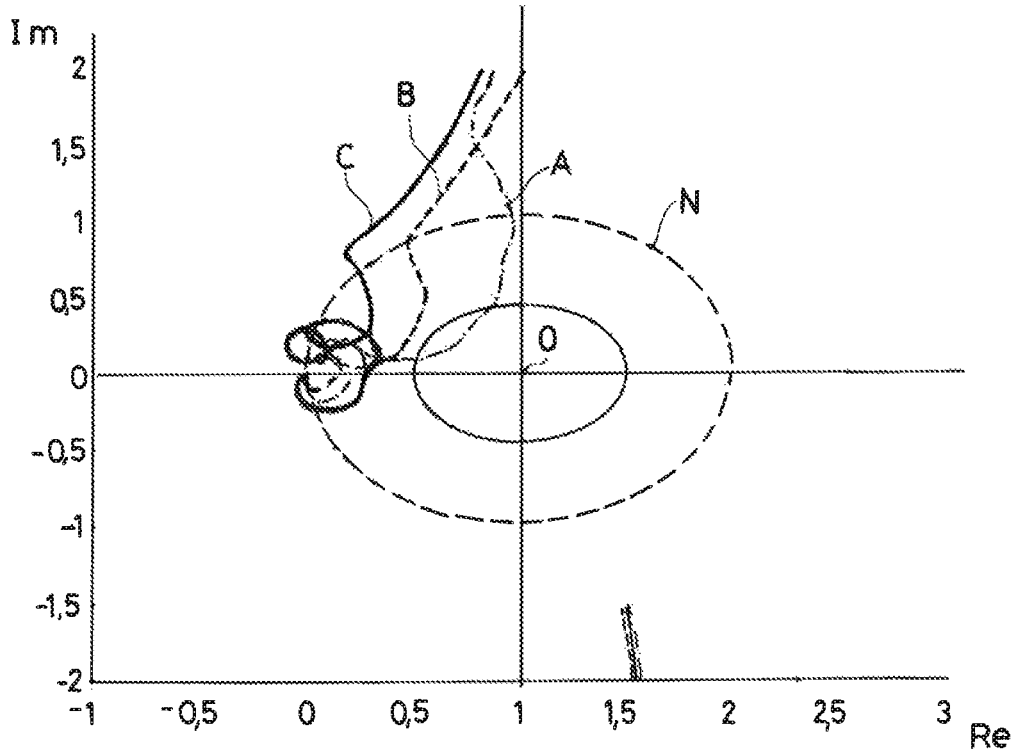
FIG. 16 is a Nyquist plot of the FIG. 7 circuit, likewise for various configurations.

For the circuit of FIG. 7, FIGS. 14 to 17 show:

FIG. 14: the modulus of the transfer function of the feedback filter;

FIG. 15: the phase of the transfer function of the feedback filter;

FIG. 16: the Nyquist plot; and

Figure 17:
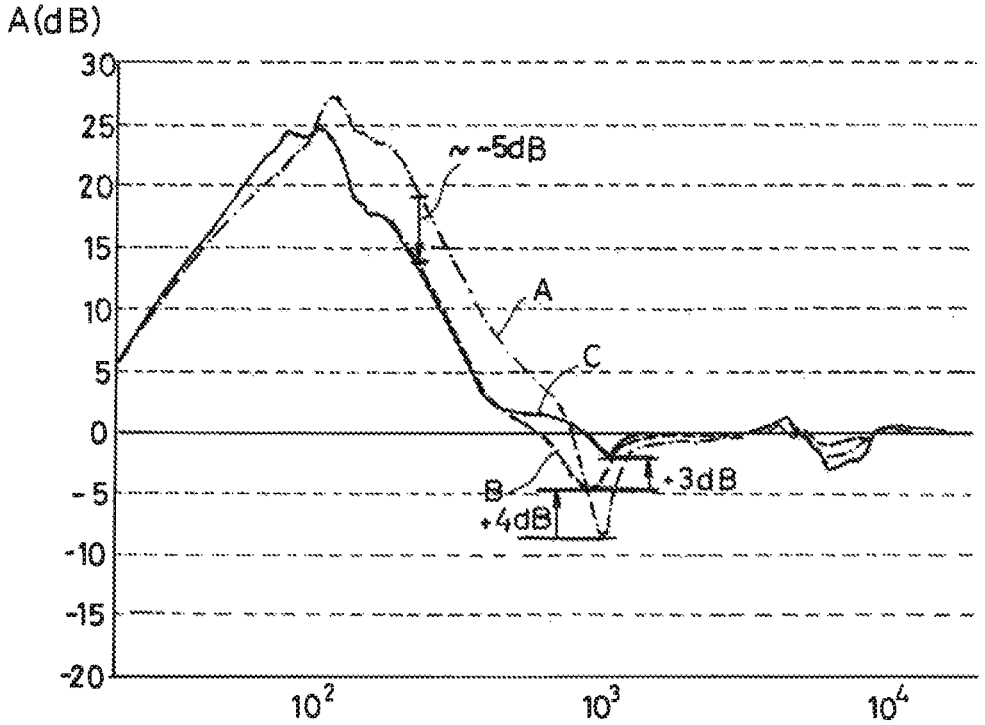
FIG. 17 shows the closed loop attenuation characteristic of the FIG. 7 circuit, likewise for various configurations.

FIG. 17: the closed-loop attenuation characteristic.

In these figures:

A represents the characteristic corresponding to the original feedback filter with its preamplification G3, prior to reducing the passband;

B represents the same characteristic as A, but after reducing the passband; and

C represents the final characteristic, i.e. characteristic B after adding the stabilizer filter 44 with its preamplification G2.

As can be seen by comparing the characteristics A and B (or C) in FIG. 14, the original passband of the filter which was 80 Hz-160 Hz, giving a band width of 80 Hz (characteristic A) is reduced to 65 Hz-115 Hz, i.e. a narrower band width of 50 Hz (characteristic B or C).

This reduction in passband makes it possible, as explained with reference to FIG. 13, to increase significantly the gain and phase margins, thereby contributing to increased stability of the system.

Examining FIG. 15 shows that using the stabilizer filter 44 significantly increases the phase in the unstable zone of the waterbed effect around 1 kHz, by about 30° to 35°.

In FIG. 16, it can be seen that this increase in phase moves the open loop significantly away from the zone of instability. This figure is a Nyquist plot in which the dashed line shows the noise amplification zone N. As can be seen, in none of the three configurations A, B, or C does the system surround the instability point O: theoretically, all of the systems are stable. Nevertheless, reducing the passband of the feedback filter (going from A to B) and associating it with a stabilizer filter (going from B to C) moves the plot each time further away from the instability point, thereby contributing to better overall stability of the system.

The theoretical attenuation curve of FIG. 17 shows that the waterbed effect zone at 1 kHz is reduced. It can be seen that the waterbed effect zone at 6 kHz is degraded but does not exceed 4 dB, like the zone at 1 kHz. This figure shows the simulated attenuation of the closed loop, in which it can be seen that the depth of the waterbed effect in the 1 kHz zone of system A is reduced on going to system B (improvement of 4 dB) and on going from system B to system C (improvement of +3 dB). The loss of attenuation of about −5 dB observed in the 100 Hz-800 Hz band on going from system A to system B or C is compensated by the active control obtained by the static feedforward filter 32.

What is claimed is:

1. An audio headset comprising two earpieces connected together by a headband and each including a transducer for playing back the sound of an audio signal that is to be reproduced, the transducer being housed in an acoustic cavity defined by a shell provided with an ear-surrounding cushion, the headset including an active noise control system comprising:

an open-loop feedforward first branch with a first bandpass filter receiving as input a signal delivered by an external microphone suitable for picking up acoustic noise existing in the environment of the headset;

a closed-loop feedback second branch with a second bandpass filter receiving as input an error signal delivered by an internal microphone inside the cavity;

a third branch with a third filter; and a mixer circuit receiving as inputs the signals delivered by the first, second, and third filters and also the audio signal to be played back, and delivering as output a signal suitable, after amplification, for controlling the transducer;

wherein:

the active noise control is non-adaptive control, the parameters of the first, second, and third filters being predetermined parameters;

the third filter is a stabilizer bandpass filter connected in parallel with the feedback second branch, receiving as input the signal delivered by the internal microphone, and delivering as output a signal that is applied as an input to the mixer circuit, the third filter being suitable for locally increasing the phase of the transfer function of the second filter in a predetermined instability zone; and the first, second, and third branches are arranged in parallel, and the mixer circuit is a summing circuit delivering as output a linear combination of the signals delivered by the first, second, and third filters together with at least a fraction of the audio signal to be played back, with respective weighting of the gains applied to these signals.

2. The audio headset of claim 1, wherein said predetermined instability zone is a waterbed effect zone around a frequency of 1 kHz.

3. The audio headset of claim 1, wherein the high cutoff frequency of the second filter is less than 150 Hz.

4. The audio headset of claim 1, wherein the bandwidth of the second filter is less than 65 Hz.

5. The audio headset of claim 1, wherein the gain margin of the feedback branch of the active noise control is at least 15 dB.

6. The audio headset of claim 1, wherein the phase margin of the feedback branch of the active noise control is at least 45°.

7. The audio headset of claim 1, wherein the audio signal to be played back is applied as input both to the second filter and to the summing circuit, the second filter receiving as input a signal obtained by combining said error signal delivered by the internal microphone with at least a fraction of the audio signal for play-back.

8. The audio headset of claim 7, wherein the audio signal that is to be played back is not applied to the third filter.

* * * * *